US006610945B2

(12) United States Patent
Onodera

(10) Patent No.: US 6,610,945 B2
(45) Date of Patent: Aug. 26, 2003

(54) SEESAW TYPE SWITCH

(75) Inventor: Hideji Onodera, Tokyo (JP)

(73) Assignee: Niles Parts Co., Ltd., Tokyo (JP)

( * ) Notice: Subject to any disclaimer, the term of this patent is extended or adjusted under 35 U.S.C. 154(b) by 0 days.

(21) Appl. No.: 10/171,500

(22) Filed: Jun. 14, 2002

(65) Prior Publication Data

US 2002/0189925 A1 Dec. 19, 2002

(30) Foreign Application Priority Data

Jun. 15, 2001 (JP) ..... P2001-181222

(51) Int. Cl.[7] ..... H01H 9/26
(52) U.S. Cl. ..... 200/315; 200/5 R
(58) Field of Search ..... 200/553, 5 R, 200/308–315, 339

(56) References Cited

U.S. PATENT DOCUMENTS 5,647,478 A * 7/1997 Hirai ..... 200/303
5,660,270 A * 8/1997 Martin et al. ..... 200/315
5,824,981 A * 10/1998 Suzuki ..... 200/302.1
5,845,767 A * 12/1998 Suzuki ..... 200/524
5,865,302 A * 2/1999 Suzuki et al. ..... 200/315

* cited by examiner

*Primary Examiner*—Elvin Enad
*Assistant Examiner*—Lisa Klaus
(74) *Attorney, Agent, or Firm*—Rader, Fishman & Grauer PLLC; Ronald P. Kananen, Esq.

(57) ABSTRACT

A seesaw type switch is provided having a light permeating indicator capable of being illuminated, and at the same time preventing ingress of dust. The switch includes a switch knob supported on left-to-right walls on both sides of a cylindrical knob fixture for oscillating operation, and a boss having a curved surface concentric with the center of the support on the side of an operation lever of the switch knob and existing over a light permeating indicator zone. Fore-to-aft facing sections facing contiguously with the curved surface on both sides before and behind the support center are provided on fore-to-aft walls of the knob fixture. Left-to-right curved surfaces facing contiguously along both sides of the curved surface of the left-to-right facing boss are provided on the left-to-right walls of the knob fixture. The light permeating indicator zone of the boss is formed by using a light permeating material.

6 Claims, 14 Drawing Sheets

(a)

(b)

(c)

SEESAW TYPE SWITCH

BACKGROUND OF THE INVENTION

1. Field of the Invention

The present invention relates generally to electrical switches. In particular, the present invention relates to seesaw type switches used in automobiles, for example, as power window switches.

2. Description of the Related Art

A seesaw type switch available conventionally is shown in FIG. 15(*a*) to FIG. 15(*c*) and, for example, in Japanese Patent Publication No. 9-167543. FIG. 15(*a*) is an exploded perspective view of the conventional seesaw type switch, FIG. 15(*b*) is a plan view thereof, and FIG. 15(*c*) is a cross section view thereof as viewed along lines SA—SA in FIG. 15(*b*).

As shown in FIGS. 15(*a*) to 15(*c*), the conventional seesaw type switch 201 has a knob fixture 205 installed on the top of a case 203, and a switch knob 209 is supported on a support pin 207 of the knob fixture 205. The switch knob 209 is capable of oscillation in fore and aft directions on the support pin 207. The switch knob 209 is provided with an operation lever 211, which is inserted into the case 203. The lower edge of the operation lever 211 is engaged with an interlock pin 215 on a movable board 213. Therefore, when the switch knob 209 is operated to oscillate fore and aft, the interlock pin 215 is operated via the operation lever 211, whereas switching operation can be performed by using the movable board 213.

A light source 217 is installed in the case 203 as shown in FIG. 15(*c*). The switch knob 209 is installed with an indicator that permeates light, wherein illumination light from the light source 217 permeating through the indicator allows easy viewing of the indicator in the switch knob 209 even at night.

However, the above construction has the top of the knob fixture 205 opening widely, allowing dust and other foreign materials to enter into the case 203 from the opening of the knob fixture 205, causing them to deposit on movable contacts and fixed contacts, thereby leading to the risk of defective operation of the movable board 213 and defects in the contacts. Particularly because the operation lever 211 of the switch knob 209 is inserted from the knob fixture 205, whose oscillating operation operates the movable board 213, the opening of the knob fixture 205 was forced to be large. At the same time, because illumination light from the light source 217 installed in the case 203 is passed through the knob fixture 205 to direct the light to the indicator of the switch knob 209, the opening of the knob fixture 205 was forced to be large also from this aspect. Therefore, it was not possible to avoid invasion of dust.

SUMMARY OF THE INVENTION

The present invention provides a seesaw type switch with high dust-proof performance, while making possible the oscillating operation of the switch knob and indication by light permeation.

According to a first aspect of the present invention, a seesaw type switch is provided in which an operation lever of a switch knob having a light permeating indicator is inserted into a cylindrical knob fixture comprising of fore-to-aft and left-to-right walls and having an opening from the opening, and the switch knob is supported on the left-to-right walls so that the knob can be operated in oscillation, the seesaw type switch being characterized in that a boss having a curved surface concentric with the center of the support and existing over a light permeating indicator zone is provided, fore-to-aft facing sections facing contiguously with the curved surface on both sides before and behind the support center are provided on fore-to-aft walls of the knob fixture, at least one of left-to-right curved surfaces facing contiguously along both sides of the curved surface of the left-to-right facing boss and the outer surface of the left-to-right walls facing contiguously with a plate drooping from the left to right of the operation knob is provided on the left-to-right walls of the knob fixture, and the part existing at least on the light permeating indicator zone of the boss is formed by using a light permeating material.

According to a second aspect of the present invention, the fore-to-aft facing part is an inner top of the fore-to-aft wall of the knob fixture, and the left-to-right curved surface is formed over the inner top of the fore-to-aft wall.

According to a third aspect of the present invention, an operation lever of a switch knob having a light permeating indicator is inserted into a cylindrical knob fixture having an opening from the opening, and the switch knob is supported so that the knob can be operated in oscillation. In this case, a boss having a curved surface concentric with the center of the support is provided on the operation lever side of the switch knob, a closely facing part contiguous with the curved surface on both fore and aft sides of the support center is provided on the knob fixture, a closing part to close the inner wall surface with the inner left-to-right wall surface and the inner rear wall surface with the inner left-to-right wall surface is provided, and the part existing at least in the light permeating indicator zone in the closing part is formed by using a light permeating material.

According to a fourth aspect of the present invention, the closing part of a seesaw type switch is equipped with a run off on the lever side to run off from interference of the operation lever in oscillation by forming a shape to alienate gradually from the support center more on the operation lever side than from the run off on the opening side to run off from interference of the switch knob in oscillation and the closely facing part.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A seesaw type switch according to a first embodiment of the present invention will be described below with reference to FIGS. 1 to 12 of the accompanying drawings.

Figure 1:
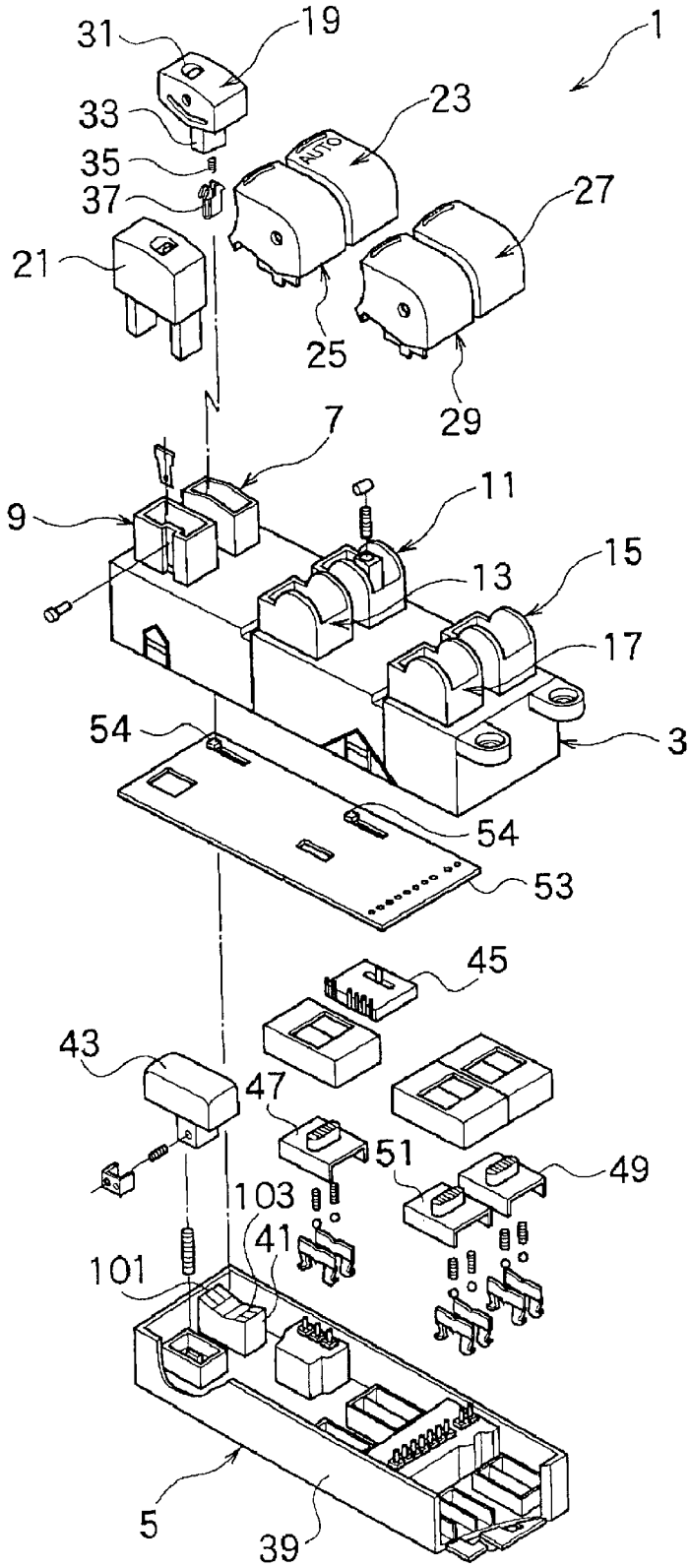
FIG. 1 is an exploded perspective view of a power window switch for automobiles, including the seesaw-type switch according to a first embodiment of the present invention.

FIG. 1 shows an exploded perspective view of a power window switch 1 for automobiles, which includes a seesaw type switch according to the first embodiment of the present invention. As shown in FIG. 1, the power window switch 1 for automobiles is provided with the case 3 and the terminal block 5, and is installed in, for example, an arm rest on the door of the driver's seat or the cabin side of the door of an automobile.

Each region, positions and directions of the members described below are described with reference to the appended drawings. In practice, the vertical, horizontal, and longitudinal directions may vary depending on arrangement of the power window switch 1 for automobiles, and are not limited thereto. The present invention is described in detail hereunder with the arbitrary states shown in the appended drawings as the base.

The case 3 presents the shape of a box with its bottom open, whose top is provided with a plurality of knob fixtures 7, 9, 11, 13, 15 and 17. Switch knobs 19, 21, 23, 25, 27 and 29 are supported on the knob fixtures 7, 9, 11, 13, 15 and 17.

The switch knob 19 is an operating member to lock a door, and is used in a seesaw type switch according to the first embodiment of the present invention. The switch knob 21 is an operating member of a push lock switch to lock a window, and is fitted to the knob fixture 9 in the case 3 free in vertical movement. The switch knob 23 is an operating member of a two-step seesaw switch to open and close a window in the driver's seat. The switch knob 23 is supported on the knob fixture 11 of the case 3 and is fitted to the case 3 free in oscillation. The switch knob 25 is an operating member of an automatic restoring type seesaw switch to open and close a window in the passenger seat next to the driver's seat. The switch knob 25 is supported on the knob fixture 13 of the case 3 and is fitted to the case 3 free in oscillation. The switch knob 27 is an operating member of an automatic restoring type seesaw switch to open and close a window in the rear passenger seat of the driver's seat side. The switch knob 27 is supported on the knob fixture 15 of the case 3 and is fitted to the case 3 free in oscillation. The switch knob 29 is an operating member of an automatic restoring type seesaw switch to open and close a window in the rear passenger seat on the right-hand side. The switch knob 29 is supported on the knob fixture 17 of the case 3 and is fitted to the case 3 free in oscillation.

The switch knob 19 is installed on its top with a light permeating indicator 31 for operation indication of the switch and for nighttime illumination indication. The light permeating indicator 31 is preferably formed by resins of two colors. The light permeating indicator 31 indicates brightly a mark to indicate the function of the switch knob 19 by directing light from below the switch knob 19, thereby allowing an operator to recognize clearly the type of the switch knob 19 at night. The light permeating indicator 31 is formed by using polycarbonate or polyacetal of white, orange or green color. The bottom side of the switch knob 19 has the operation lever 33 installed integral therewith. A movable contact 37 formed by bending an electrically conductive metal into a U-shape, for example, is supported on the operation lever 33 via a coil spring 35.

The terminal block 5 is equipped with a housing 39 constructed by means of insert molding and includes a plurality of conductive plates in continuity with the terminal and fixed contact 101, 103. The housing 39 is arranged with a moving block 43, an auto switch 45, and moving blocks 47, 49, 51, in addition to a fixed contact support 41 installed therein.

A circuit substrate 53 is also supported on the housing 39 of the terminal block 5. The circuit substrate 53 is installed with a light emitting diode (LED) 54 or a lamp as the light source. The circuit substrate 53 is fitted into an opening on the upper side of the housing 39, and fixed by inserting a terminal protruding upward from the housing 39 into a through-hole and soldering it thereon.

Then, a movable contact 37 of the switch knob 19 is connected elastically in the installed condition onto the fixed contact support 41. The switch knob 21 has such a constitution that it interlocks the moving block 43, the switch knob 23 interlocks the auto switch 45 constructed of a small slide switch, and the switch knobs 25, 27, 29 turn the respective movable contacts on and off and interlock the moving blocks 47, 49, 51.

Figure 2:
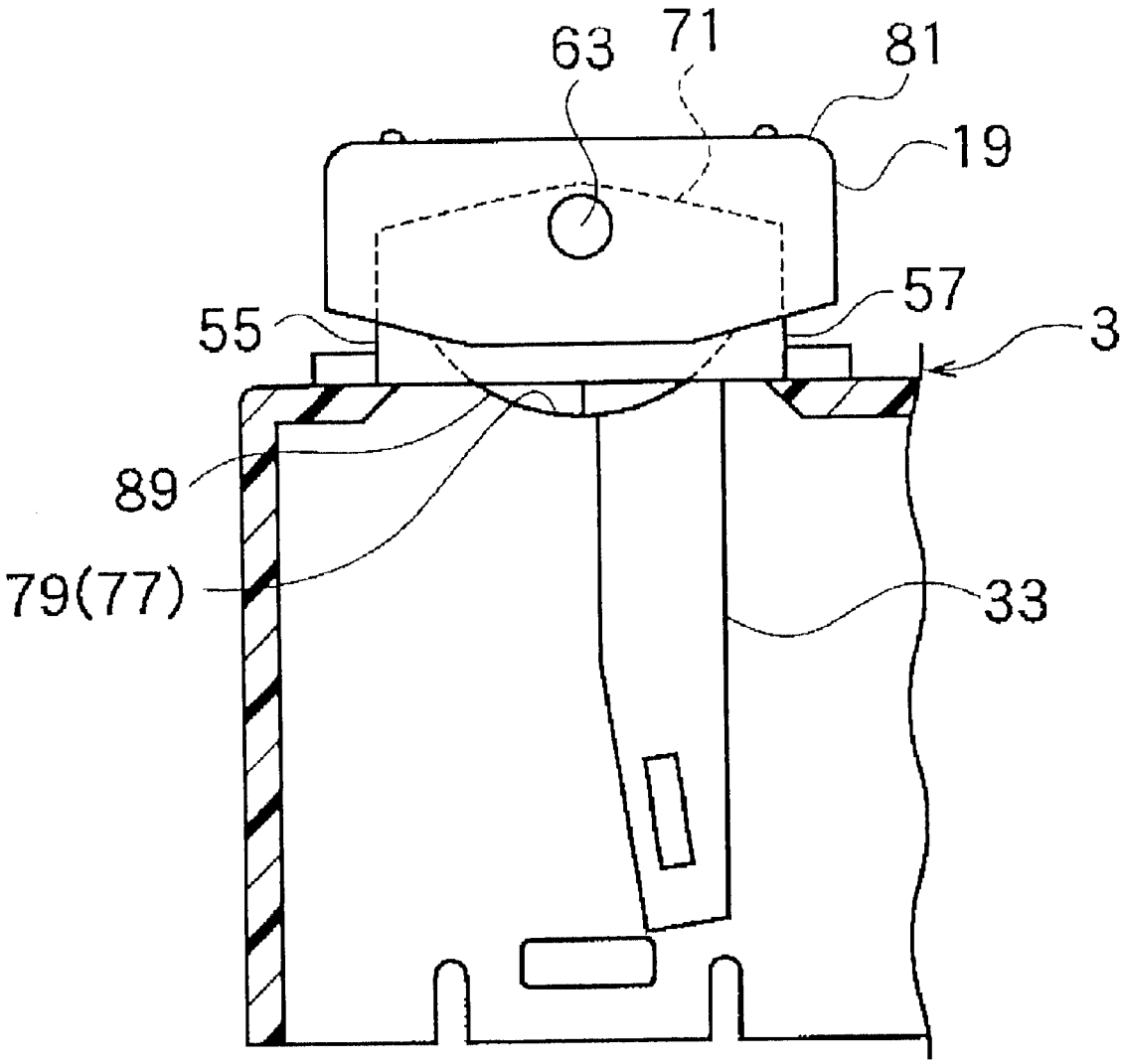
FIG. 2 is a partly cutout side view of the seesaw-type switch with the switch knob supported on the knob fixture according to the first embodiment of the present invention.
Figure 3:
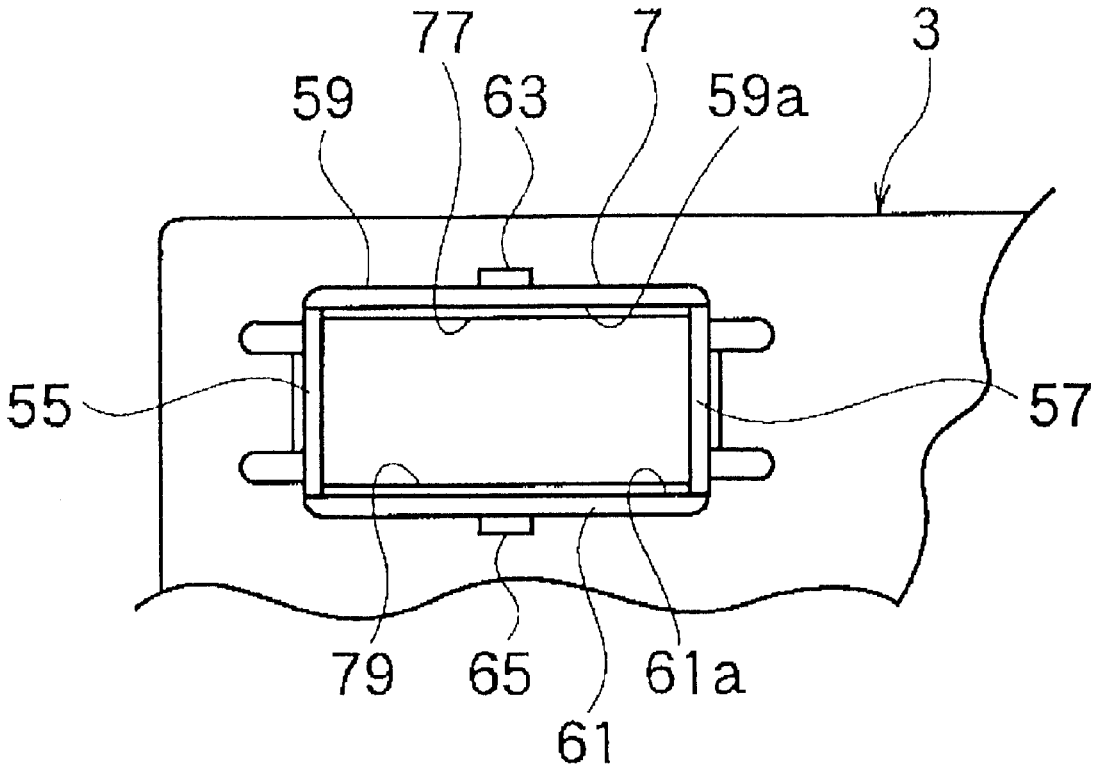
FIG. 3 is a plan view of the switch knob fixture and the surroundings thereof according to the first embodiment of the present invention.
Figure 4:
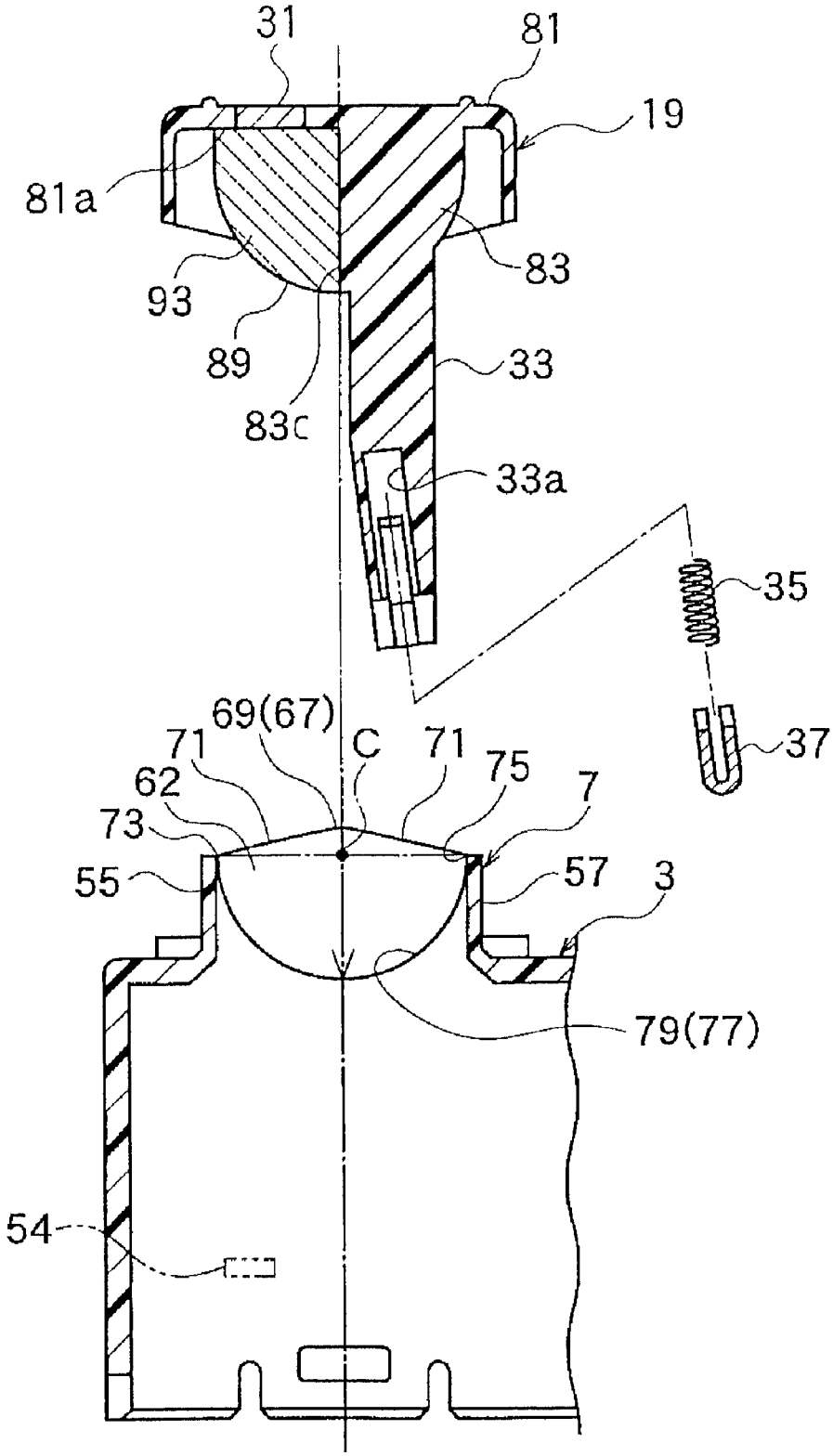
FIG. 4 is an exploded cross section view of the switch knob and the knob fixture as seen from the front direction according to the first embodiment of the present invention.
Figure 5:
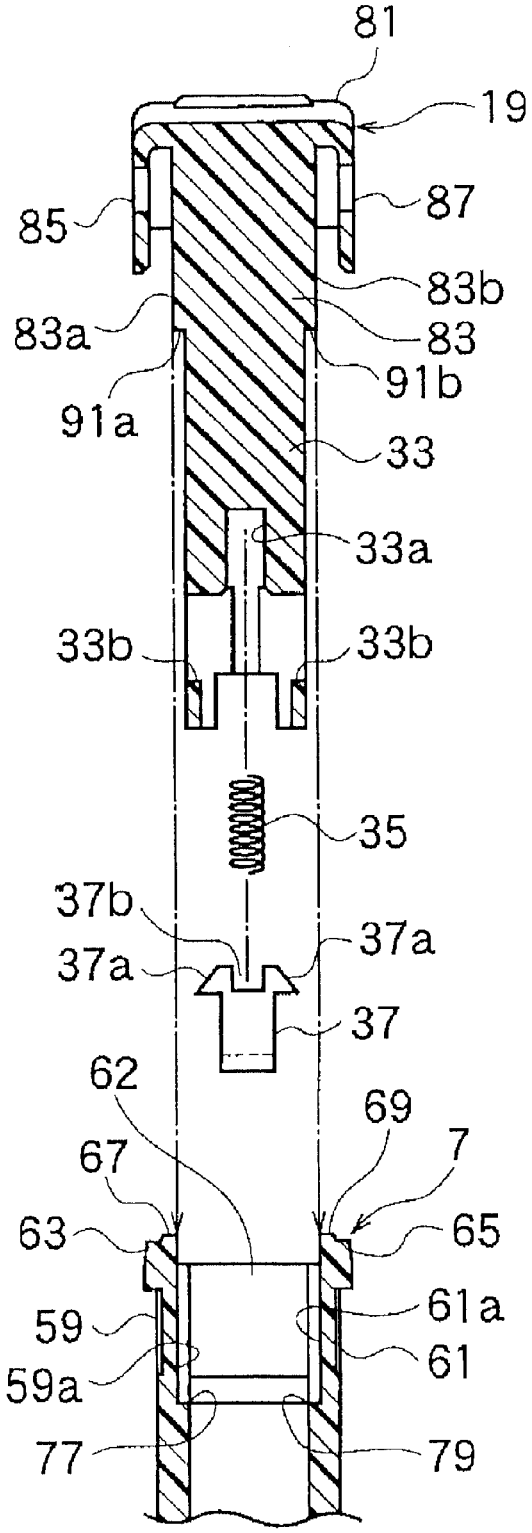
FIG. 5 is an exploded cross section view of the switch knob and the knob fixture as seen from the side direction according to the first embodiment of the present invention.

Further explanation is given hereunder on the specific structure in the part of the switch knob 19 being a seesaw type switch according to the first embodiment of the present invention. FIG. 2 is a partly cutout plan view of the switch knob 19 having been fitted to the case 3, FIG. 3 is a plan view of the case 3 in the part of the knob fixture 7 with the switch knob 19 removed, FIG. 4 is an exploded cross section view seen from the front of the case 3 at the switch knob 19 and the knob fixture 7, and FIG. 5 is an exploded cross section, view seen from the side direction of the case 3.

The knob fixture 7 comprises fore-to-aft walls 55, 57 and left-to-right walls 59, 61, and is formed cylindrical having an opening 62 on the upper edge. On the outer surface at the center of the left-to-right walls 59, 61, supporting shafts 63, 65 are installed integral therewith and protrude as shown in FIGS. 2 and 5. The center of the supporting shafts 63, 65 are set to the same height as that at the upper edge of the fore-to-aft walls 55, 57, while the left-to-right walls 59, 61 have center upper edges 67, 69 that protrude higher and have a slanted surface 71 before and behind thereof. The slanted surface 71 extends to the upper edge of the fore-to-aft walls 55, 57.

The tops inner to the fore-to-aft walls 73, 75 of the fore-to-aft walls 55, 57 of the knob fixture 7 constitute fore-to-aft facing sections, and are positioned on both fore-to-aft sides of the center of the supporting shafts 63, 65 being the support center "C" of the switch knob 19. The tops inner to the fore-to-aft walls 73, 75 face contiguously with the curved surface 89, described later, of the switch knob 19. In this embodiment, the contiguously facing position of the tops inner to the fore-to-aft walls 73, 75 toward the curved surface 89 is set to approximately the same height as that for the support center "C." However, it is possible to make the fore-to-aft walls 55, 57 of the knob fixture 7 lower than the support center "C," set the fore-to-aft facing section at a position lower than the support center "C," and have it contiguously face with the curved surface 89.

The left-to-right walls of the knob fixture 7 are provided with the left-to-right curved surfaces 77, 79. These left-to-right curved surfaces 77, 79 are so constituted as to face contiguously with the switch knob 19 along both sides of the curved surface described later. The left-to-right curved surfaces 77, 79 are formed in an arc concentric with the support center "C," and formed over the inner wall surface of the fore-to-aft walls 55, 57. In other words, the upper edge of the left-to-right curved surfaces 77, 79 extends to the tops inner to the fore-to-aft walls 73, 75 of the fore-to-aft walls 55, 57. In addition, the inner surfaces of the left-to-right walls 59*a*, 61*a* of the left-to-right walls 59, 61 are constituted as the left-to-right facing section which faces contiguously with both sides of the boss 83, described later, of the switch knob 19.

The switch knob 19 has the operation lever 33 integratedly on the rear side of the knob operating section 81, with the boss 83 being provided on the side of the operation lever 33. The support holes 85, 87 are pierced and formed on the left and right sides of the knob operating section 81. The support holes 85, 87 are fitted to the support shafts 63, 65. The switch knob 19 is supported by the support shafts 63, 65 so that the knob can be operated in oscillation in the directions to the fore-to-aft walls 55, 57 around the support center "C."

Figure 10:
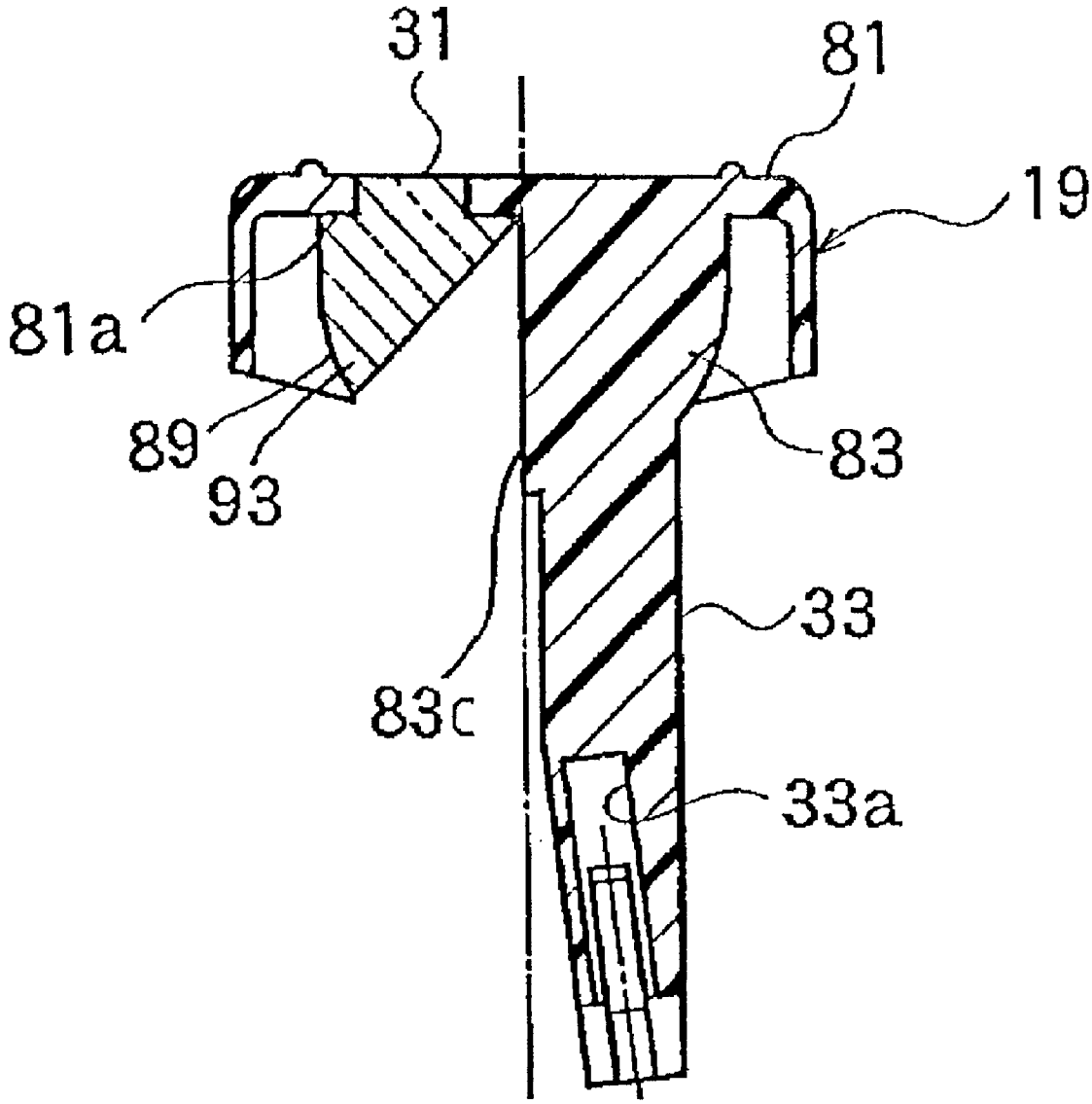
FIG. 10 is a cross section view of the switch knob as seen from the front direction according to the first embodiment of the present invention.
Figure 11:
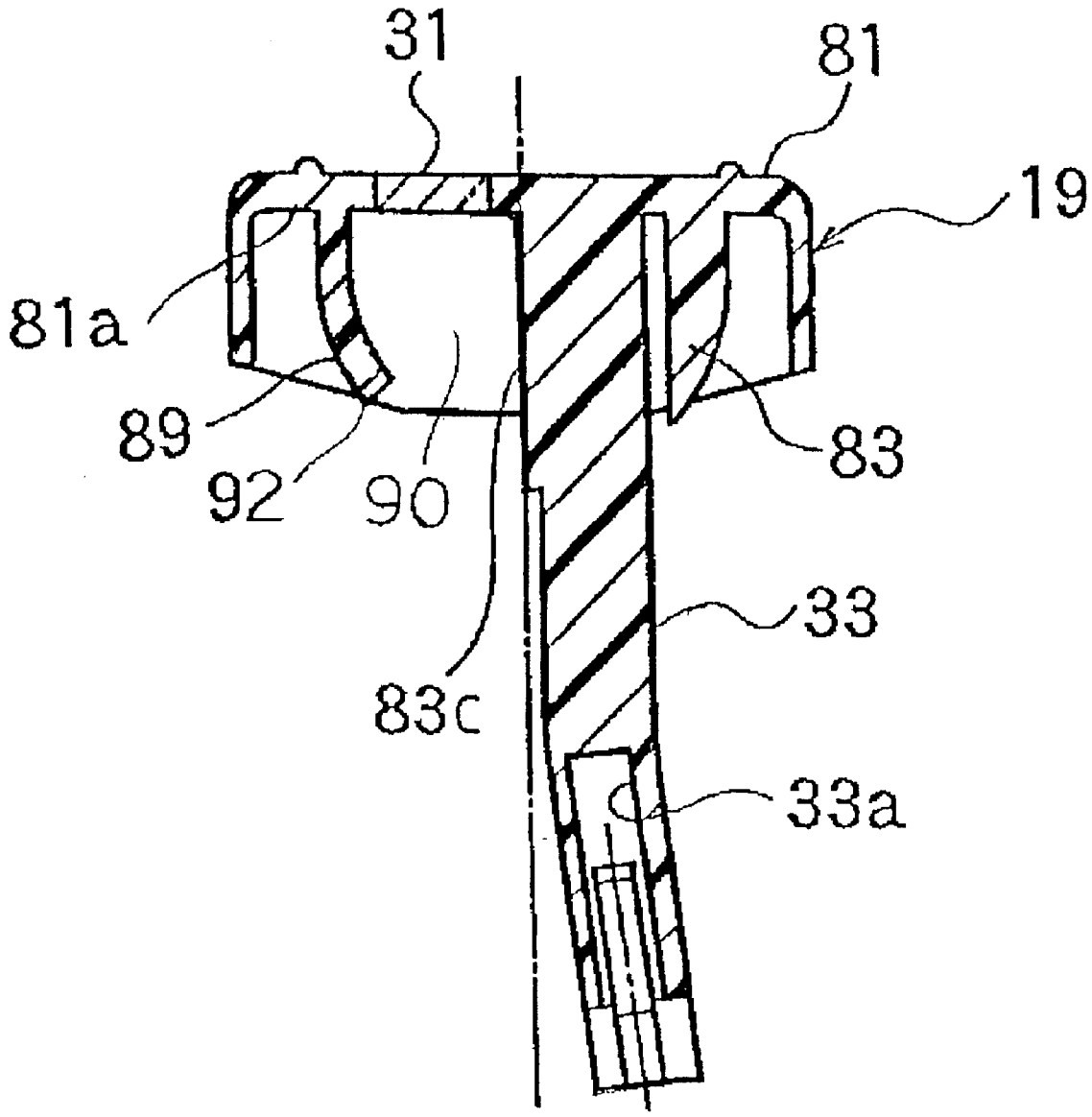
FIG. 11 is a cross section view of the switch knob as seen from the front direction, showing another variation of the first embodiment of the present invention.
Figure 12:
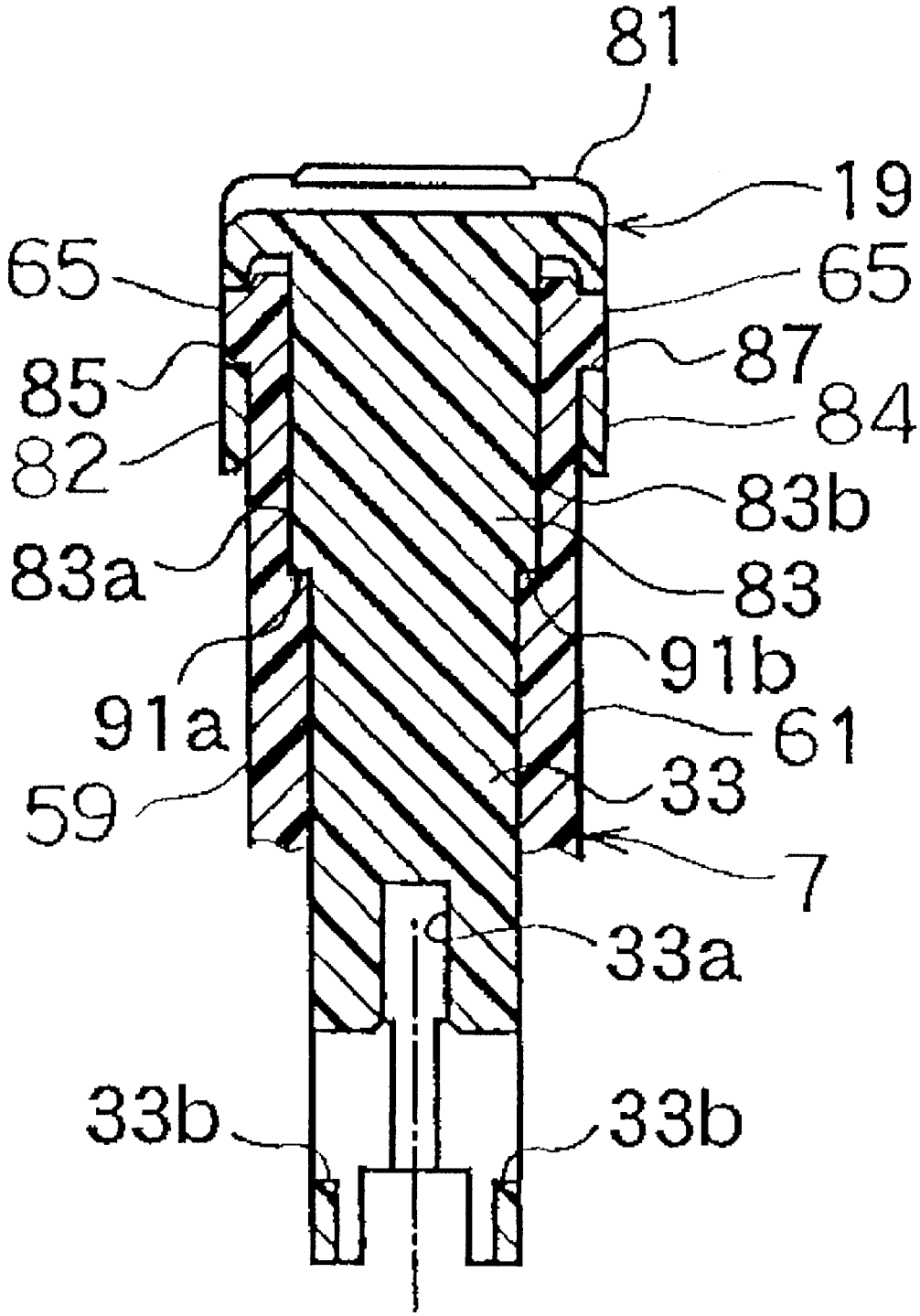
FIG. 12 is a cross section view of the switch knob and the knob fixture in the assembled condition as seen from the side direction, showing another variation of the first embodiment of the present invention.

The boss 83 has the curved surface 89 concentric with the support center "C," and is a protrusion protruded from the rear side of the knob operating section 81 and the operation lever 33. The boss 83 has, as shown in FIGS. 5 and 12, both of the left and right sides 83*a*, 83*b* installed on the inner surface of the left-to-right walls 59*a*, 61*a*, the boss fixture 7 with the switch knob 19 kept oscillatable and with the clearance reduced to as small as possible, while the curved surface 89 on fore and aft sides of the boss 83 is formed with a semicircular pillar, a circular protrusion or a spherical protrusion as shown in FIGS. 4, 10 and 11. The curved surface 89 is so arranged as to be kept contiguous at all times with the tops inner to the fore-to-aft walls 73, 75 to provide the function of a lid to close the opening 62 on the knob fixture 7 at the boss 83 to prevent an ingress of dust. The curved surface 89 has the same curvature as for the left and right curved surfaces 77, 79 of the knob fixture 7, and is so constituted that the left and right curved surfaces 77, 79 face contiguously with both sides of the curved surfaces 91*a*, 91*b* in the installed condition. Contiguous facing of the left and right curved surfaces 77, 79 with both sides of the curved surfaces 91*a*, 91*b* includes the state that the left and right curved surfaces 77, 79 contact closely both sides of the curved surfaces 91*a*, 91*b*.

In the assembled condition, the inner surface of the left-to-right walls 59*a*, 61*a* faces contiguously with both sides' 83*a*, 83*b* of the boss 83 as the left-to-right facing section. Contiguous facing of the inner surface of the left-to-right walls 59*a*, 61*a* of the knob fixture 7 with both sides 83*a*, 83*b* of the boss 83 includes the state that both parts contact closely with each other.

The boss 83 exists over the light permeating indicator 31 zone of the switch knob 19. In this embodiment, about half of the boss 83 is formed by the light permeating element 93. The light permeating element 93 is fixed on the fixing surface 83*c* of the rear side 81*a* of the knob operating section 81 and the boss 83 by, for example, adhesion in correspondence with the light permeating indicator 31. In the meantime, the light permeating element 93 may be engaged and fixed removably to the rear side 81*a* and the fixing surface 83*c* by means of a concavo-convex structure. For example, the light permeating element 93 may be fitted by one-touch action to the boss 83 by forming an arc-shaped convex portion on the surface bonding the light permeating element 93 and the boss 83 together, and forming a concave portion into which the convex portion is fitted, and fitting them with each other. The light permeating element 93 is formed transparent or translucent by, for example, acryl and/or polycarbonate. The light permeating element 93 is a member to eliminate clearance between the guide to guide the light of the light emitter 54 to the light permeating indicator 31 and the knob fixture 7 of the operation lever 33 for the purpose of dust prevention.

In addition, as shown in FIG. 10, the light permeating element 93 may be an element which integrates the light permeating indicator 31 with the boss 83. Furthermore, the fore-to-aft side of the boss 83 may suffice its purpose if it has at least the curved surface 89, and the operation lever is allowed to have a hollow notch.

Furthermore, the light permeating element 93 may not necessarily be as shown in FIG. 11. In this case, the boss 83 can have the curved surface 89 formed by protruding the protrusion 92, whose cross section is arc or semi-spherical, from the rear side 81*a* of the knob operating section 81, and the space 90 formed in the curved surface 89 so that light from the light emitting element 54 can be led into the light permeating indicator 31. Thus, the protrusion 92 has a function to prevent an ingress of dust similarly to the boss 83 described previously and shown in FIG. 4, and the space 90 has a function to guide the light from the light emitting element 54 into the light permeating indicator 31.

The operation lever 33 is, as shown in FIGS. 1, 4 and 5, formed with the blind hole 33*a* to insert the coil spring 35 into the edge on the fixed contact support 41 (lower edge in FIGS. 4 and 5). The set pin hole 33*b* is formed in continuation on the opening side of the blind hole 33*a* to engage the pawl 37*a* formed on the upper left-to-right edge of the movable contact 37. The coil spring 35 has its one end inserted into the blind hole 33*a*, and the other end inserted into and supported by the notch 37*b* formed on the center of the edge on the side of the switch knob 19 in the movable contact 37. The coil spring 35 has a role of a contact spring to energize the movable contact 37, as well as a role of a restraining spring to energize the movable contact 37 as a restraining body to press the contact onto the slanted surfaces 95, 97 as the restraining grooves and the trough 99.

Figure 6:
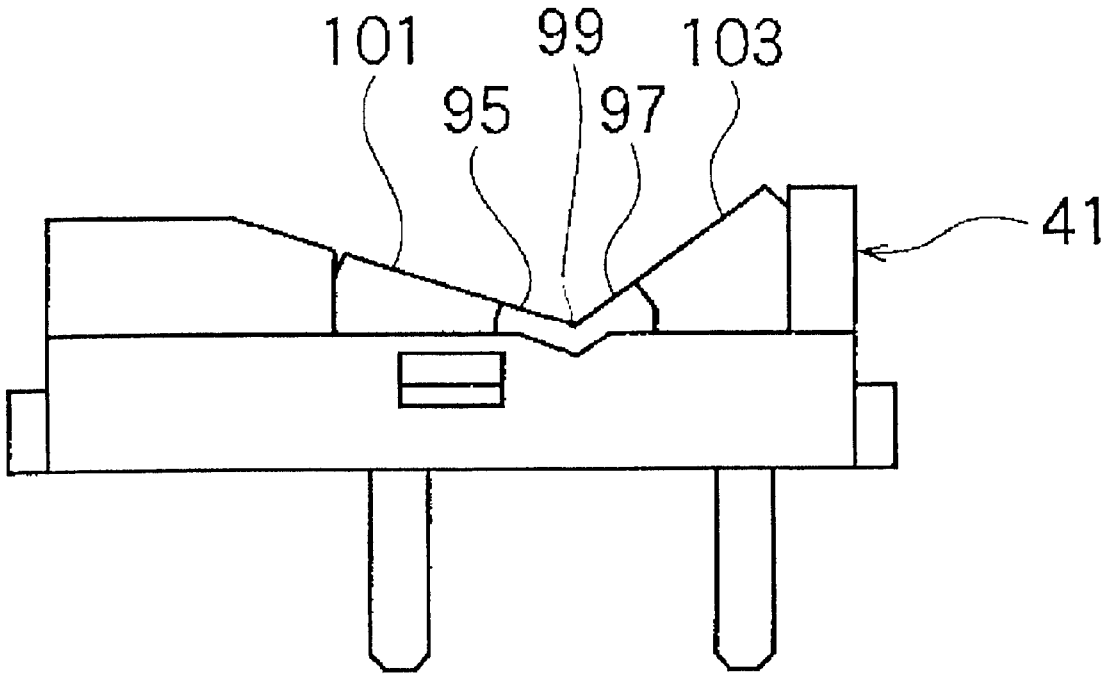
FIG. 6 is a front view of the contact support for the switch according to the first embodiment of the invention.
Figure 7:
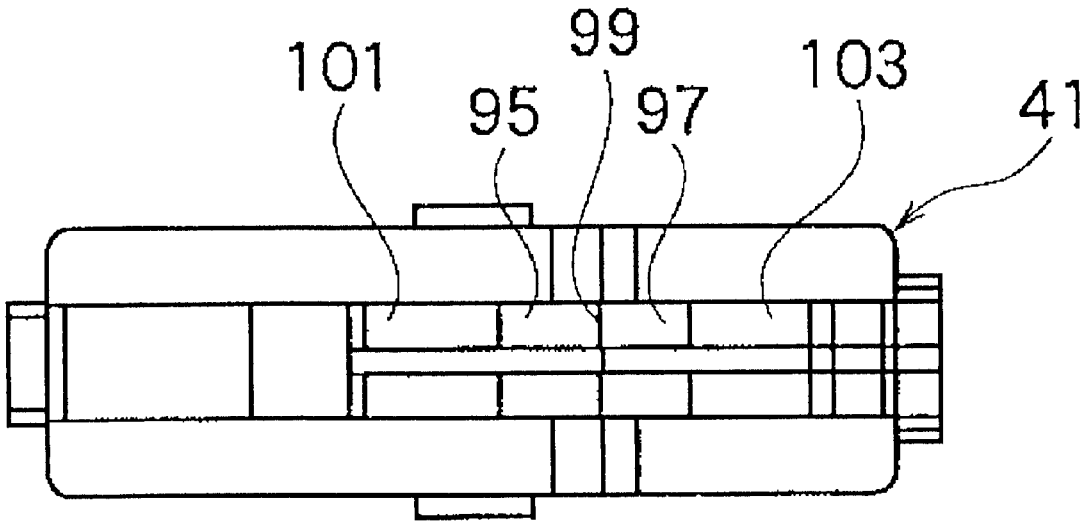
FIG. 7 is a plan view of the contact support for the switch according to the first embodiment of the invention.

The fixed contact support 41 is structured as shown in FIGS. 6 and 7. FIG. 6 is a front view of the fixed contact support 41, and FIG. 7 is a plan view thereof. The fixed contact support 41 is provided with the slanted surfaces 95, 97 to return automatically the switch knob 19 from the ON position to the OFF position, and formed with the trough 99 to support the switch knob 19 in the OFF position between the slanted surfaces 95, 97. The slanted surfaces 95, 97 have the fixed contacts 101, 103, which are formed by insertion into the terminal block 5, exposed flush with the slanted surfaces 95, 97.

The switch knob 19 has the operation lever 33 inserted from the opening 62 of the knob fixture 7, whereas the support holes 85, 87 are fitted into the support shafts 63, 65. The switch knob 19 is supported on the left-to-right walls 59, 61 so that the knob can be operated in oscillation. The movable contact 37 supported on the operation lever 33 contacts elastically the fixed contact support 41 by means of the energizing force of the coil spring 35.

Under these conditions, the tops inner to the fore-to-aft walls 73, 75 of the fore-to-aft walls 55, 57 in the knob fixture 7 face contiguously with the curved surface 89 of the boss 83, and the left-to-right curved surfaces 77, 79 in the knob fixture 7 face contiguously with both sides of the curved surface 91*a*, 91*b* in the boss 83. Therefore, the opening 62 in the knob fixture 7 is closed by the boss 83, preventing an ingress of dust from the opening 62. Thus, dust is prevented from being deposited on the movable contact 37 and the fixed contacts 101 and 103. As a result, trouble caused by inferior contact of the movable contact 37 with the fixed contact 101 or 103 can be prevented. Especially because the left-to-right curved surfaces 77, 79 were formed over the inner surface of the fore-to-aft walls 55, 57, or in other words, the tops inner to the fore-to-aft walls 73, 75, the knob fixture 7 can be closed easily by the curved surface 89 of the boss 83, the inner surfaces of the fore-to-aft walls 55, 57, and the left-to-right curved surfaces 77, 79, ensuring reliably the dust preventing performance.

In addition, an ingress of dust can be suppressed by only either the contiguous facing of the left-to-right curved surfaces 77, 79 with both sides of the curved surfaces 91*a*, 91*b*, or the contiguous facing of the inner surface of the left-to-right walls 59*a*, 61*a* with both of the left and right sides 83*a*, 83*b*. Therefore, when the inner surfaces of the left-to-right walls 59*a*, 61*a* are faced contiguously with both of the left and right sides 83*a*, 83*b*, an ingress of dust can be suppressed even if the left-to-right curved surfaces 77, 79 are slightly separated from both sides of the curved surfaces 91*a*, 91*b*.

Dust prevention by both of the left and right sides 83*a*, 83*b* of the switch knob 19 may be performed, as shown in FIG. 12, by having both of the left and right sides 83*a*, 83*b* drooped down from the left and right edges of the knob operating section 81 of the switch knob 19, by providing a clearance between the shaft hole forming plates 82, 84 formed with the support holes 85, 87 and the outer surfaces of the left-to-right walls 59, 61 to an extent that the switch knob 19 can be oscillated, and by arranging them to face contiguously.

Furthermore, in this embodiment, the light permeating indicator 31 can be illuminated by the illuminating light generated by light emission of the light emitting element 54 on the circuit substrate 53 to pass through the light permeating element 93. Therefore, even if the boss 83 exists in order to prevent an ingress of dust, the light permeating indicator 31 can be illuminated unstrained, and the light permeating indicator 31 on the switch knob 19 can be viewed easily even at night. In addition, the parts other than the light permeating element 93 of the boss 83 are non-light permeating, thereby suppressing the light from the light emitting element 54 to leak outside the switch knob 19.

In operating the switch, when either front or rear part of the knob operating section 81 in the switch knob 19 is pressed, the switch knob 19 can be operated oscillatingly by using the support shafts 63, 65 of the knob fixture 7 as the center. Since the curved surface 89 of the boss 83 faces at this time contiguously with the left-to-right curved surfaces 77, 79 of the knob fixture 7, with the support center "C" as the center, the switch knob 19 can be operated oscillatingly unstrained. In performing this oscillating operation, if such a construction is taken as the curved surface 89 is contacted and guided to the left-to-right curved surfaces 77, 79 of the knob fixture 7, stable oscillating operation and play prevention can be executed in the switch knob 19.

In performing the oscillating operation of the switch knob 19, the movable contact 37 ascends on either one of the slanted surfaces 95 or 97 in resistance to the energizing force of the coil spring 35, and reaches either one of the fixed contact 101 or 103, allowing the contact of the movable contact 37 with the fixed contacts 101, 103 to be performed reliably. Moreover, if the operation is stopped by removing a finger from the switch knob 19, the movable contact 37 is so energized as to descend the slanted surface 95 or 97 by the coil spring 35. Therefore, the movable contact 37 returns automatically to the trough 99, providing the reliable control and positioning of the switch knob 19.

In addition, while the support shafts 63, 65 were provided on the outer side of the left and right sides 59, 61 of the knob fixture 19 in this embodiment, it is also possible to provide them in the inner side.

Figure 8:
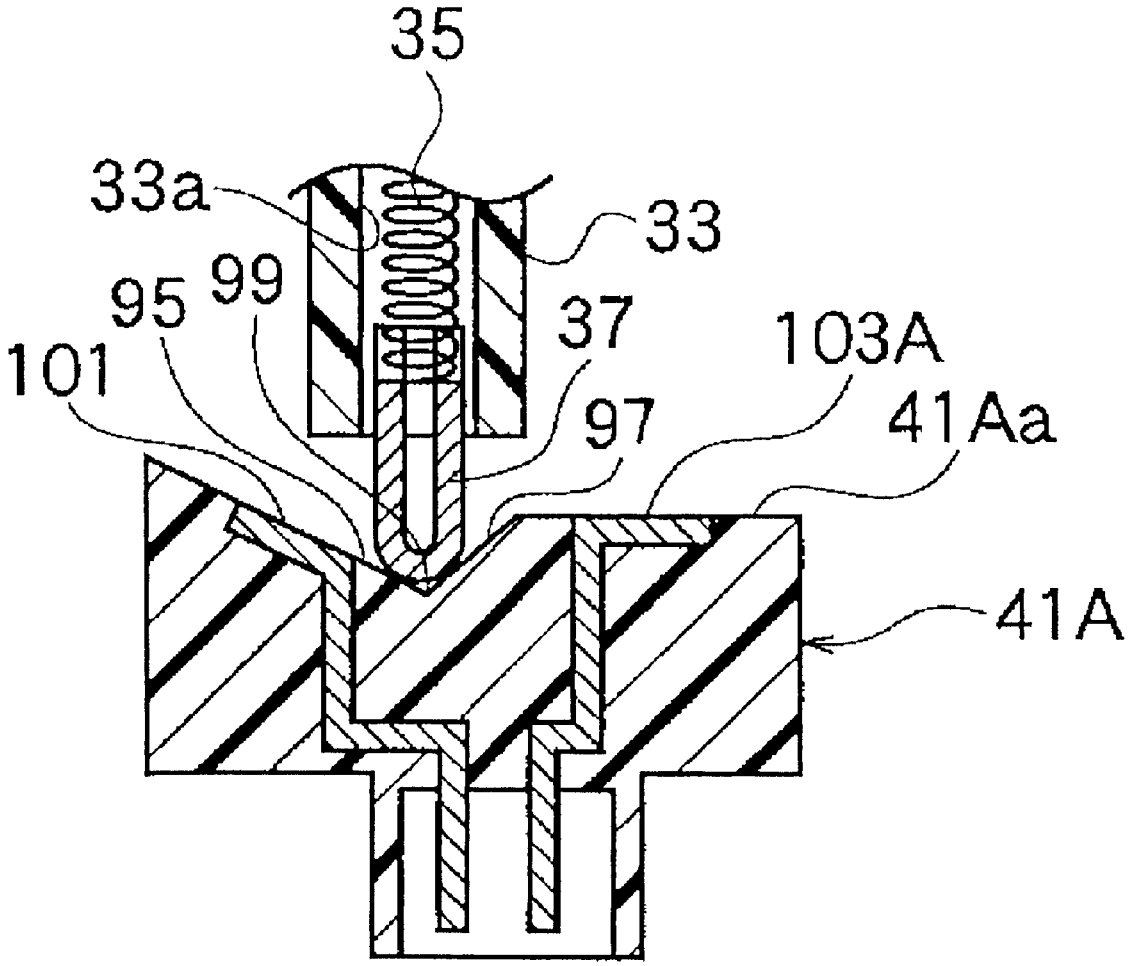
FIG. 8 is a cross section view of a variation of the contact support according to the first embodiment of the present invention.
Figure 9:
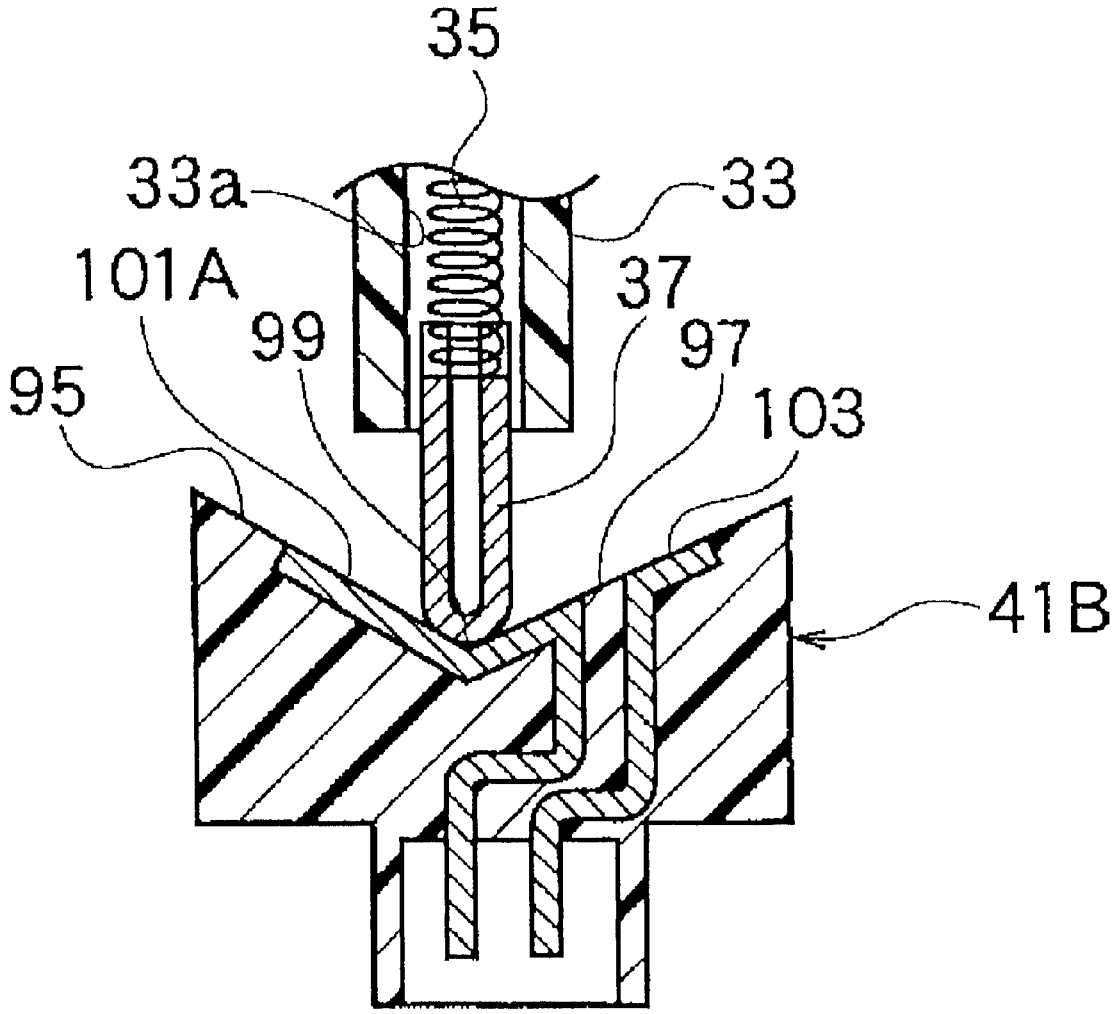
FIG. 9 is a cross section view of another variation of the contact support according to the first embodiment of the present invention.

FIGS. 8 and 9 illustrate variations of the contact support 41. In the contact support 41A in FIG. 8, the horizontal surface 41Aa is also arranged with a fixed contact 103A, wherein this fixed contact 103A is contacted with the movable contact 37. The condition that the operation knob 19 is slanted is retained by pressing the movable contact 37 energized by the coil spring 35 onto the horizontal surface 41Aa. If the operation knob 19 is given an oscillating operation in the direction opposite thereto, the movable contact 37 turns ON as a result of contacting the fixed contact 101, and when a hand is left from the operation knob 19, the movable contact 37 slides down the slanted surface 95 by the elastic force of the coil spring 35, and returns automatically to the OFF position in the trough 99.

In the contact support 41B in FIG. 9, the fixed contact 10A is so arranged that it reaches to the slanted surface 97 from the slanted surface 95 via the trough 99. When the movable contact 37 is at the neutral position of the operation knob 19 in the trough 99 and at the slanted surface 95, the contact is made with the fixed contact 101A. When the operation knob 19 is operated for oscillation in the direction that the movable contact 37 ascends the slanted surface 97, the movable contact 37 switches as a result of contacting the fixed contact 103. Since the contact support 41B is a V-shaped restraining groove, automatic return is executed to the trough 99 even if the operation knob 19 is operated for oscillation in the fore-to-aft direction.

(Second Embodiment)

A second embodiment of the Applicant's invention will now be explained in detail with reference to FIGS. 13 and 14 of the accompanying drawings.

Figure 13:
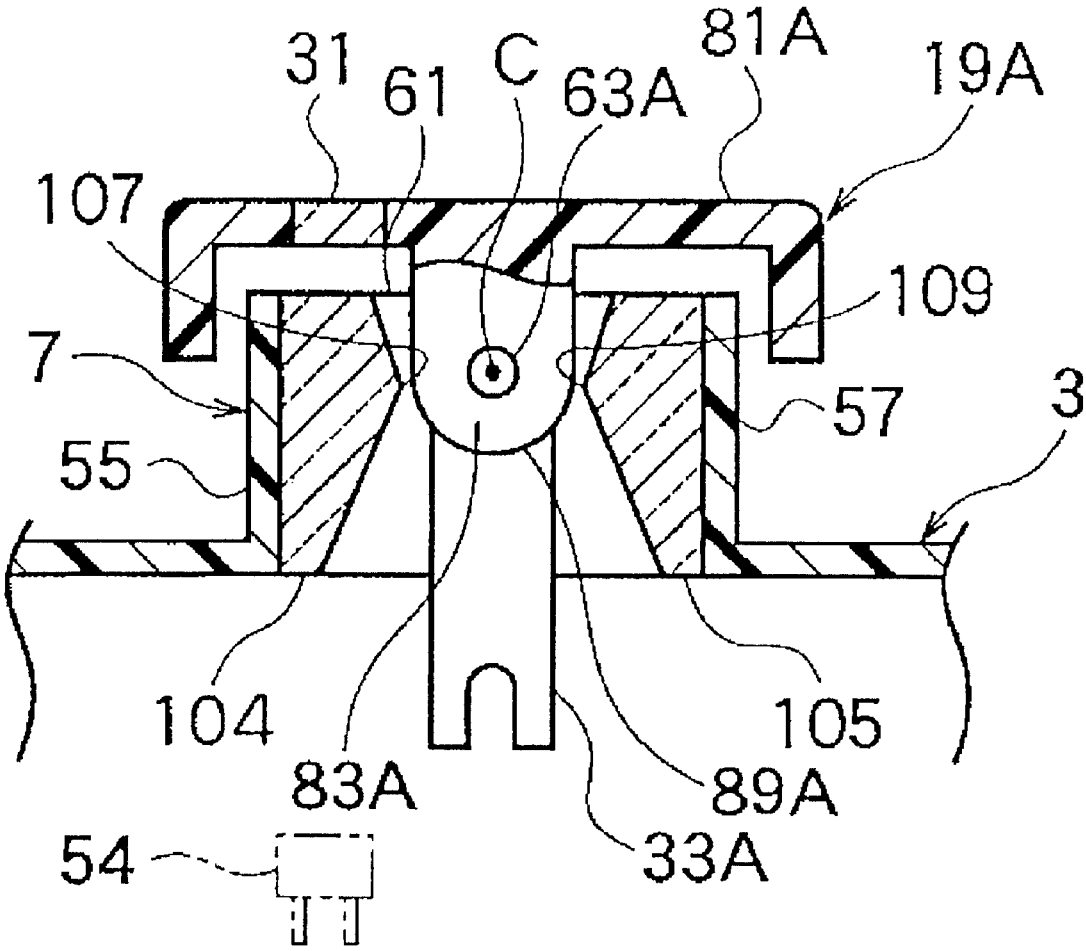
FIG. 13 is a cross section view of a switch knob and a knob fixture of a seesaw-type switch in the assembled condition, according to a second embodiment of the present invention.
Figure 14:
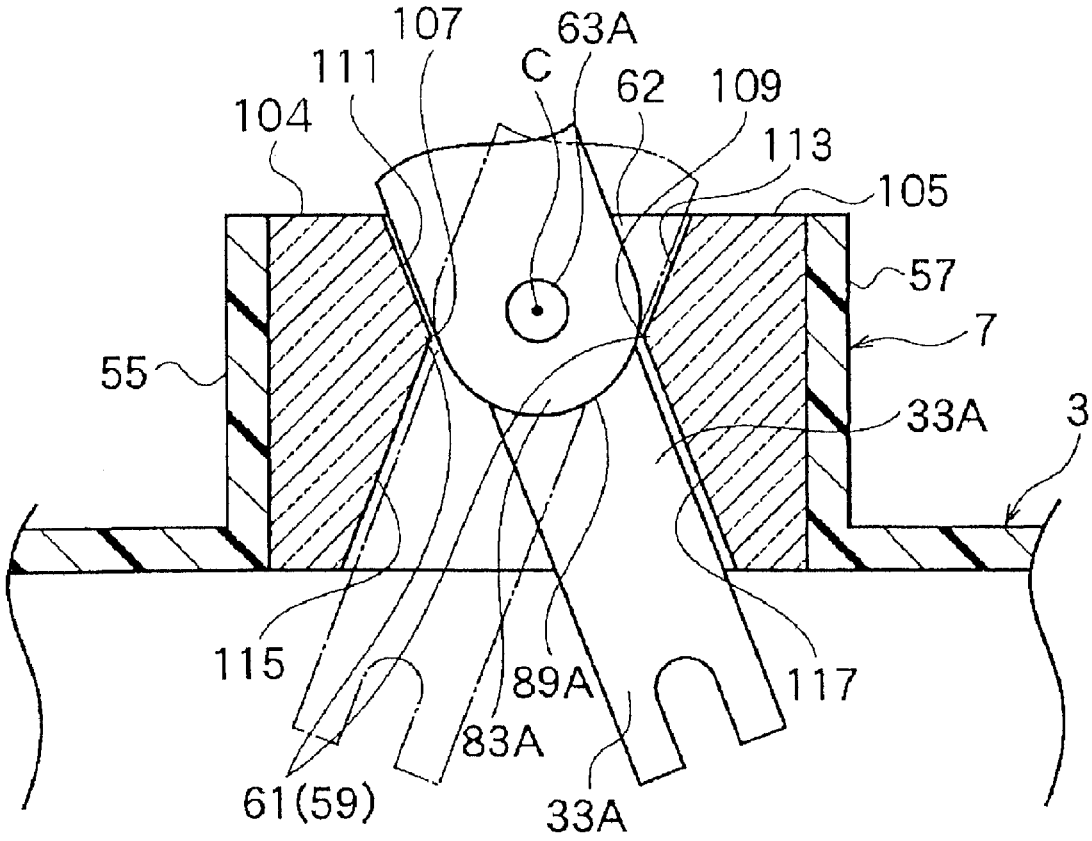
FIG. 14 is an enlarged cross section view of a critical part of the seesaw-type switch according to the second embodiment of the present invention.
Figure 15:
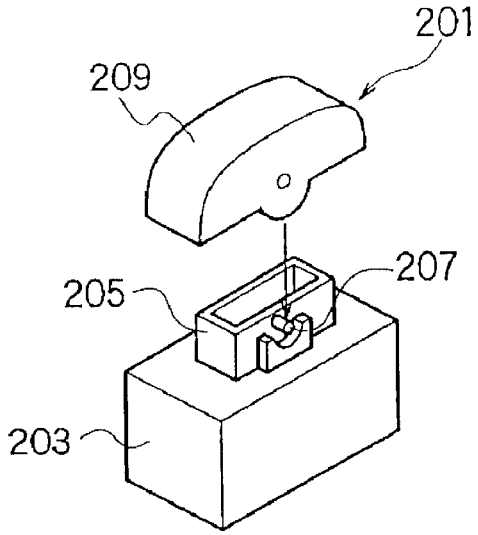
FIGS. 15(*a*) to 15(*c*) show conventional switch knob and knob fixture assemblies, wherein FIG. 15(*a*) is an exploded perspective view showing the relationship between the switch knob and the knob fixture, FIG. 15(*b*) is a side view of the switch knob assembled into the knob fixture, and FIG. 15(*c*) is a cross section view of the conventional switch knob and knob fixture assembly taken along lines SA—SA in FIG. 15(*b*).
Figure 15:
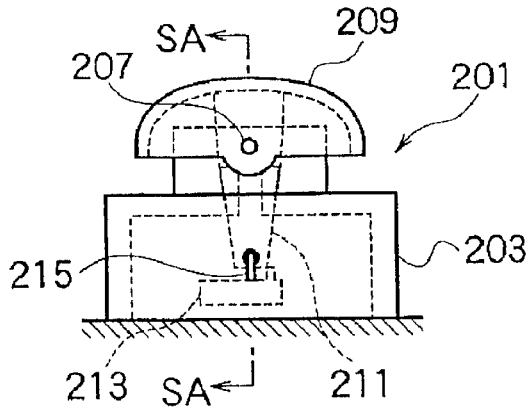
Figure 15:
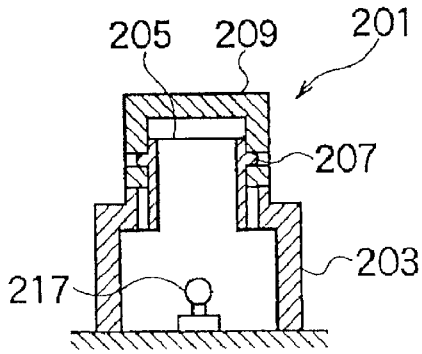

FIG. 13 is a cross section view of the critical part, and FIG. 14 is an expanded cross section view thereof. The structures corresponding to the first embodiment are explained with the same symbols given.

A boss 83A is provided on the side of the operation lever 33A in the switch knob 19A in this embodiment. The switch knob 19A is supported by the support shaft 63A installed on the left-to-right wall of the knob fixture 7 in the part of the boss 83A so that the knob can be operated in oscillation. Furthermore, the boss 83A has the curved surface 89A concentric with the support center "C." The boss 83A is formed smaller than the boss 83 in the first embodiment.

The knob fixture 7 is provided with closing members 104, 105 to constitute the closing section. The closing member 104 is equipped with a contiguously facing section 107 that faces contiguously with the curved surface 89A of the boss 83A in front of the support center "C." The closing member 105 is equipped with a contiguously facing section 109 that faces contiguously with the curved surface 89A in rear of the support center "C." These contiguously facing sections 107, 109 are constituted as the top of the closing members 104, 105. The contiguously facing sections 107, 109 are positioned slightly lower than the support center "C" when the top faces the curved surface 89A in order to allow the boss 83A to oscillate as shown in FIG. 14.

The closing members 104, 105 are equipped with run offs 111, 113 on the opening side and run offs 115, 117 on the lever side. The run offs 111, 113 on the opening side are formed slanted to alienate gradually from the support center "C" on the opening side of the knob fixture 7 more on the contiguously facing sections 107, 109. The run offs 115, 117 on the lever side are formed slanted to alienate gradually from the support center "C" on the operation lever 33A side more on the contiguously facing sections 107, 109.

The outline with angular cross section as shown in FIG. 14, formed by the contiguously facing sections 107, 109, the run offs 111, 113 on the opening side and the run offs 115, 117 on the lever side, has such a construction that the inclination angle coincides with the oscillation angle of the boss 83A and the operation lever 33A so that it faces contiguously at the maximum oscillating positions of the boss 83A and the operation lever 33A.

The closing member 104 is fitted to the inner surface of the front wall 55 and the inner surface of the left-to-right walls 59, 61 of the knob fixture 7, by means of adhesion or concavo-convex engagement, and this fitting closes the inner surface of the front wall 55 and the inner surface of the left-to-right walls 59, 61. The closing member 105 is fitted to the inner surface of the rear wall 57 and the inner surface of the left-to-right walls 59, 61 of the knob fixture 7, by means of adhesion or concavo-convex engagement, and this fitting closes the inner surface of the rear wall 57 and the inner surface of the left-to-right walls 59, 61.

Meanwhile, the concavo-convex engagement is a means to fix the closing members 104, 105 by one-touch action to the knob fixture 7 by, for example, forming an arc-shaped convex portion on the outer circumference of the closing members 104, 105, by forming a concave portion structured by through holes to have the convex portion engage with, on the inner surfaces of the front wall 55 and the left-to-right walls 59, 61 of the knob fixture 7, and fitting the convex portion and the concave portion with each other.

The closing members 104, 105 are formed transparent or translucent by light permeating materials, such as acryl and polycarbonate. The closing members 104, 105 may be formed with the light permeating materials for the part existing at least on the light permeating indicator 31 zone, such that only the closing member 104 may be formed with the light permeating materials, and the closing member 105 with non-light permeating materials. Such a construction can suppress more reliably the light from the light emitting element to leak from the surrounding of the switch knob 19A.

Also in this embodiment, the inner surface of the left-to-right walls 59, 61 of the knob fixture 7 face contiguously with both sides of the boss 83A as the left-to-right facing section. In addition, similarly to the first embodiment, it is possible to install the left-to-right curved surface facing contiguously along both sides of the curved surface 89A of the boss 83A in the inner surface of the left-to-right walls 59, 61 of the knob fixture 7.

In this embodiment, since the closing members 104, 105 close the clearance between the knob fixture 7 and the switch knob 19A, ingress of dust from the opening 62 of the knob fixture 7 into inside can be suppressed, and the contact action can be performed reliably.

Especially in operating the switch knob 19 for oscillation as shown in FIG. 14, in order for the opening side run offs 111, 113 to run off from interference of the switch knob 19A in oscillation, the contiguously facing sections 107, 109 may be approached as close as possible to the curved surface 89A of the boss 83A, thus an ingress of dust may be suppressed reliably. Also in this embodiment, because the inner surface of the left-to-right walls 59, 61 of the knob fixture 7 faces contiguously with both sides of the boss 83A, ingress of dust may be suppressed reliably.

Because the closing member 104 is formed by light permeating materials and installed inside the knob fixture 7 made of non-light permeating materials, the light permeating indicator 31 can be illuminated by the light from the light emitting element without any leakage of light, allowing the light permeating indicator 31 to be viewed easily even at night.

The dust preventing structures of the switch knobs 19, 19A described above in the first and second embodiments may be applied to all types of seesaw switches and lever switches, including switch knobs 23, 25, 27 and 29 in which the knobs are oscillated.

According to the first aspect of the present invention, because an operation lever of a switch knob having a light permeating indicator is inserted into a cylindrical knob fixture comprising fore-to-aft and left-to-right walls and having an opening from the top, the switch knob can be supported on the left-to-right walls so that the knob can be operated in oscillation. Furthermore, because a boss having a curved surface concentric with the center of the support and existing over a light permeating indicator zone is provided on the operation lever side of the switch knob, and a fore-to-aft facing section closely facing the curved surface on both of the before and behind sides of the support center is provided on the fore-to-aft walls of the knob fixture, the clearance between the fore and aft walls of the switch knob and the knob fixture can be closed by making the fore-to-aft facing section to face contiguously with the curved surface of the boss. Also because at least one of the left-to-right facing section facing contiguously with both sides of the boss, the left-to-right curved surface facing contiguously along both sides of the boss, and the outer surface of the left-to-right walls facing contiguously with a plate drooping from the left to right of the operation knob, is provided on the left-to-right walls of the knob fixture, the clearance between the left-to-right walls of the knob fixture and the boss can be closed by at least one of the left-to-right facing sections being made to face contiguously with both sides of the boss, or the left-to-right curved surface being made to face contiguously with both sides of the curved surface of the boss, or the outer surface of the left-to-right walls being made to face contiguously with the plate drooping from the left to right of the operation knob. Therefore, either clearance between the fore-to-aft and left-to-right walls of the switch knob and the knob fixture can be closed, making it possible to suppress largely an ingress of dust even if an opening is present on the knob fixture. Furthermore, because the part existing on at least the light permeating indicator zone of the boss is formed by using a light permeating material, light from the light source is directed to the light permeating indicator through the light permeating material, so that the indicator is illuminated brightly. Accordingly, it is possible to ensure light permeating indication by using the light source of the switch knob, allowing to view accurately the light permeating indicator of the switch knob even at night.

According to the second aspect of the invention, the fore-to-aft facing section is the top inner to the fore-to-aft wall of the knob fixture, and because the left-to-right curved surface is formed over the top inner to the fore-to-aft wall, the knob fixture can be easily closed by using the curved surface of the boss, the top inner to the fore-to-aft wall of the knob fixture, and the left-to-right curved surface to ensure retaining the dust preventing performance.

According to the third aspect of the invention, the switch knob can be supported so that it can be operated in oscillation because the operation lever having the light permeating indicator is inserted into the cylindrical knob fixture having an opening from the opening. In addition, because the boss having curved surface concentric with the support center is provided on the side of the operation lever of the switch knob, and a closely facing section contiguous with the curved surface on both fore and aft sides of the support center is provided on the knob fixture, and a closing section to close the inner wall surface with the inner left-to-right wall surface and the inner rear wall surface with the inner left-to-right wall surface is provided, the clearance between the switch knob and the knob fixture can be closed reliably. Therefore, an ingress of dust from the opening of the knob fixture into the interior is suppressed, providing high dust preventive effect and making the contact operation performed reliably. In addition, because the part existing on at least the light permeating indicator zone of the closing section is formed by using a light permeating material, light from the light source is directed to the light permeating indicator through the light permeating material, so that the indicator is illuminated brightly. Accordingly, it allows viewing accurately the light permeating indicator of the switch knob even at night.

According to the fourth aspect of the invention, because the closing part is equipped with an opening side run off to run off from interference of the switch knob in oscillation by forming a shape to alienate gradually from the support center more on the closely facing section than from the run off on the opening side to run off from interference of the switch knob in oscillation, and with the lever side run off to run off from interference of the operation lever in oscillation by forming a shape to alienate gradually from the support center more on the operation lever side than from the closely facing section, the oscillating operation of the switch knob can be performed reliably, while closing is being made by the closing section.

While the invention has been specifically described in connection with specific embodiments thereof, it is to be understood that this is by way of illustration and not of limitation, and the scope of the appended claims should be construed as broadly as the prior art will permit.

What is claimed is:

1. A seesaw type switch, comprising:

a switch knob having an operation lever and a light permeating indicator;

a knob fixture having fore-to-aft walls and left-to-right walls and an opening defined by said fore-to-aft walls and said left-to-right walls for receiving the operation lever of the switch knob, said left-to-right walls having a support thereon for supporting said switch knob for oscillating operation;

said switch knob having a boss having a curved surface concentric with a center of said support and existing over a light permeating indicator zone;

said fore-to-aft walls of said knob fixture having fore-to-aft facing sections facing contiguously with said curved surface of said boss on both sides before and behind the center of said support;

said left-to-right walls of said knob fixture having left-to-right curved surfaces facing contiguously along both sides of the curved surface of the boss, and said left-to-fight walls further comprising an outer surface facing contiguously with a plate drooping from the left to right of said switch knob; and at least a part of the boss existing over said light permeating indicator zone is formed using a light permeating material.

2. The seesaw type switch as claimed in claim 1, wherein said fore-to-aft facing sections are at an inner top of the fore-to-aft walls of said knob fixture, and said left-to-right curved surfaces are formed over said inner top of the fore-to-aft wall.

3. The seesaw type switch as claimed in claim 1, wherein said left-to-right walls and said fore-to-aft walls of said knob fixture together define a tubular configuration having a rectangular cross section.

4. A seesaw type switch comprising:

a switch knob having an operation lever and a light permeating indicator;

a knob fixture having an opening and a support for supporting said switch knob within said opening for oscillating operation;

a boss having a curved surface concentric with a center of said support provided on an operation lever side of said switch knob;

said knob fixture having a closely facing part contiguous with said curved surface of said boss on both fore and aft sides of the center of said support;

a closing part arranged to close an inner front wall surface of said knob fixture with an inner left-to-right wall surface, and to close an inner rear wall surface of said knob fixture with an inner left-to-right wall surface; and a portion of said closing part existing at least in said light permeating indicator zone being made of a light permeating material.

5. The seesaw type switch as claimed in claim 4, wherein said closing part is equipped with a run off on an operation lever side to run off from interference of said operation lever in oscillation by forming a shape to alienate gradually from the center of said support more on said operation lever side than from the run off on the opening side to run off from interference of said switch knob in oscillation and said closely facing part.

6. The seesaw type switch as claimed in claim 5, wherein said left-to-right walls and said fore-to-aft walls of said knob fixture together define a tubular configuration having a rectangular cross section.

* * * * *